United States Patent [19]

Donovan

[11] Patent Number: 4,855,720

[45] Date of Patent: Aug. 8, 1989

[54] ANTI-THEFT SKI ALARM

[76] Inventor: Leo P. Donovan, 311 Fisher St., Walpole, Mass. 02081

[21] Appl. No.: 196,476

[22] Filed: May 20, 1988

[51] Int. Cl.[4] ..... G08B 13/14; H01H 47/00

[52] U.S. Cl. ..... 340/571; 248/553; 361/172

[58] Field of Search ..... 340/571, 572, 542–543, 340/825.31; 70/58, 432, 439; 248/553; 361/170, 172; 280/809, 816

[56] References Cited

U.S. PATENT DOCUMENTS

| | | | |
|---|---|---|---|
| 3,913,880 | 10/1975 | Lucasey et al. | 248/553 X |
| 3,914,756 | 10/1975 | Seyk | 340/571 |
| 4,023,157 | 5/1977 | Miller | 340/571 |
| 4,272,763 | 6/1981 | Chang et al. | 340/571 |
| 4,274,077 | 6/1981 | Feiger | 340/571 X |
| 4,275,391 | 6/1981 | Okamura | 340/571 |
| 4,376,935 | 3/1983 | Castaldo | 340/571 |
| 4,394,644 | 7/1983 | Dileo et al. | 340/571 |
| 4,535,322 | 8/1985 | Yeski | 340/571 |
| 4,598,272 | 7/1986 | Cox | 340/571 X |
| 4,603,829 | 8/1986 | Koike et al. | 248/553 |
| 4,609,780 | 9/1986 | Clark | 361/172 X |
| 4,712,763 | 12/1987 | Leite | 248/553 |
| 5,685,234 | 8/1987 | Anderson et al. | 340/572 X |

*Primary Examiner*—Glen R. Swann, III
*Assistant Examiner*—Thomas J. Mullen, Jr.
*Attorney, Agent, or Firm*—Jerry T. Kearns

[57] ABSTRACT

An anti-theft ski alarm has a generally rectangular housing having a flat bottom surface provided with a slot. A peg having an enlarged head portion adapted to be received within the slot is secured to the upper surface of a ski to be protected. The enlarged head of the peg is inserted into the slot and an arming switch of the device is actuated, which causes a latch to block removal of the peg from the slot. A spring biased solenoid rod operates to block opening of the latch unless a code is correctly entered on a keypad. When the correct code is entered, a relay energizes the solenoid to retract the solenoid rod allowing the latch to be moved to an open position. An audible alarm within the device is actuated by a vibration switch which detects movement of the skis. The keypad includes a plurality of "dummy" keys to prevent breaking of the code sequence.

7 Claims, 5 Drawing Sheets

ANTI-THEFT SKI ALARM

BACKGROUND OF THE INVENTION

1. Field of the Invention

The present invention relates to alarm devices, and more particularly pertains to a new and improved anti-theft alarm for skis. At ski areas, many times a skier must remove and store their skis in an unattended rack. For example, when the skier goes to lunch, the skis are placed in a rack along with scores of other skis. While some areas furnish locking racks for the secure retention of skis, these locking racks are expensive and only a limited number are usually provided. Many times, an individual returns from lunch to find that their expensive skis have been stolen. Not only has the skier lost their skis, but has additionally lost an entire day of skiing. As lift ticket prices in many areas are currently about thirty dollars, this amounts to a considerable additional expense, in addition to considerable inconvenience and frustration. In order to overcome these problems, the present invention provides an inexpensive alarm device for attachment to a ski to prevent unauthorized movement.

2. Description of the Prior Art

Various types of alarm devices are known in the prior art. A typical example of such an alarm device is to be found in U.S. Pat. No. 4,272,763, which issued to B. Chang on June 9, 1981. This patent discloses an attache case with an automatic alarm system which includes a pair of micro switches mounted in the handle thereof. If the micro switches are actuated, the edges of the attache case will produce a high voltage electric shock, and if the attache case is moved, an alarm is sent out. The electric shock and alarm are intended to prevent the attache case from being stolen. U.S. Pat. No. 4,275,391, which issued to H. Okamura on June 23, 1981, discloses a portable alarm device which senses movement of the device and actuates an alarm. A pendulum with an attached magnet is set in motion by movement of the device, causing closing of alarm circuit read switches which actuates a continuous alarm. The pendulum may be set by a control member and removable key to a hold position to prevent its oscillation or to a release position to allow its oscillation. U.S. Pat. No. 4,376,935, which issued to S. Castaldo on Mar. 15, 1983, discloses a handbag provided with automatic illuminating and alarm devices. The device includes a switch unit having at least one electrical terminal on its exterior, a magnetically responsive switch in its interior connected to the terminal, and a battery in the handbag connected to the terminal and to the magnetically responsive switch. The terminal is adapted to receive either an illumination device or alarm device at the option of the handbag owner. A magnet is utilized in conjunction with the novel switch unit, with the switch unit being mounted on one exterior wall of the handbag, and the magnet being mounted on another interior wall of the handbag in a position opposite, and in substantial alignment with the switch unit. The magnet is supportable in at least two different positions on its mounting such that when in a first position it can interact with the magnetically responsive switch as the handbag is opened or closed, thus causing the illumination of a bulb or sounding of the alarm as the handbag is opened. U.S. Pat. No. 4,394,644, which issued to A. DiLeo et al on July 19, 1983, discloses a purse alarm which utilizes an electric circuit concealed within a purse or satchel. The circuit includes an alarm in series with a battery in a switch, the switch being kept open by a prong inserted into a matching hole. Withdrawal of the prong results in closure of the switch and activation of the alarm. A switching device is recessed within the matching hole in such a manner that mere inserted therein or poking with a sharp tip object cannot suffice to deactivate the alarm. A cord or wire attachable to both the prong in a part of the owner's body effects withdrawal of the prong, and hence triggering of the alarm, when the purse or satchel is pulled away from the owner. U.S. Pat. No. 4,598,272, which issued to R. Cox on July 1, 1986, discloses an electronic alarm which enables monitoring of the whereabouts of an individual or an article. The device includes radio frequency transmitter and receiving units.

While the above mentioned devices are suited for their intended usage, none of these devices provide an anti-theft alarm suitable for the protection of skis left unattended at a rack. Additionally, none of the aforesaid devices disclose an alarm provided with a slotted portion for the reception of a peg attached to an upper surface of a ski. Additional features of the present invention, not disclosed by the aforesaid prior art devices, include the use of a solenoid actuated rod to block removal of a peg from a slot unless a correct coded sequence is entered on a keypad. Inasmuch as the art is relatively crowded with respect to these various types of alarm devices, it can be appreciated that there is a continuing need for and interest in improvements to such alarm devices, and in this respect, the present invention addresses this need and interest.

SUMMARY OF THE INVENTION

In view of the foregoing disadvantages inherent in the known types of alarm devices now present in the prior art, the present invention provides an improved anti-theft ski alarm. As such, the general purpose of the present invention, which will be described subsequently in greater detail, is to provide a new and improved anti-theft ski alarm which has all the advantages of the prior art alarm devices and none of the disadvantages.

To attain this, a representative embodiment of the concepts of the present invention is illustrated in the drawings and makes use of a generally rectangular housing having a flat bottom surface provided with a slot. A peg having an enlarged head portion adapted to be received within the slot is secured to the upper surface of a ski to be protected. The enlarged head of the peg is inserted into the slot and an arming switch of the device is moved, which causes a latch to block removal of the peg from the slot. A spring biased solenoid rod operates to block opening of the latch unless a code is correctly entered on a keypad. When the correct code is entered, the solenoid is energized to retract the solenoid rod allowing the latch to be moved to an open position. An audible alarm within the device is actuated by a vibration switch which detects movement of the skis. The keypad includes a plurality of "dummy" keys to prevent breaking of the code sequence.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved anti-theft ski alarm which has all the advantages of the prior art alarm devices and none of the disadvantages.

It is another object of the present invention to provide a new and improved anti-theft ski alarm which may be easily and efficiently manufactured and marketed.

It is a further object of the present invention to provide a new and improved anti-theft ski alarm which is of a durable and reliable construction.

An even further object of the present invention is to provide a new and improved anti-theft ski alarm which is susceptible of a low cost of manufacture with regard to both materials and labor, and which accordingly is then susceptible of low prices of sale to the consuming public, thereby making such alarm devices economically available to the buying public.

Still yet another object of the present invention is to provide a new and improved anti-theft ski alarm which provides in the apparatuses and methods of the prior art some of the advantages thereof, while simultaneously overcoming some of the disadvantages normally associated therewith.

Still another object of the present invention is to provide a new and improved anti-theft ski alarm to prevent unauthorized movement of skis left unattended in a rack.

Yet another object of the present invention is to provide a new and improved anti-theft ski alarm which utilizes a keypad to allow deactivation of the alarm by proper entry of a coded sequence.

Even still another object of the present invention is to provide a new and improved anti-theft ski alarm which includes an interlock latching mechanism for preventing removal of the alarm from a ski until a correct code sequence is entered on a keypad.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a schematic diagram illustrating the electrical circuit of the anti-theft ski alarm of the present invention.

DESCRIPTION OF THE PREFERRED EMBODIMENT

Figure 1:
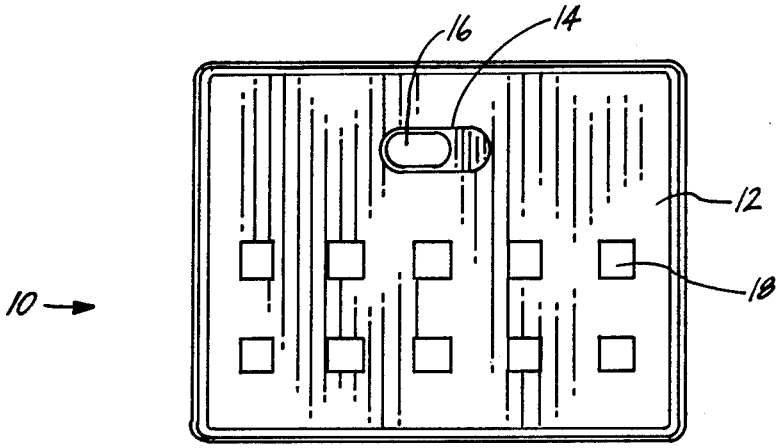
FIG. 1 is a top view of the anti-theft ski alarm of the present invention.

With reference now to the drawings, and in particular to FIG. 1 thereof, a new and improved anti-theft ski alarm embodying the principles and concepts of the present invention and generally designated by the reference numeral 10 will be described.

More specifically, it will be noted that the first embodiment 10 of the invention includes a hollow rectangular housing 12. A switch 16 is received for sliding movement within a slot 14 formed through the housing 12. A plurality of push button type keys 18 also extend through the upper surface of the housing 12.

Figure 2:
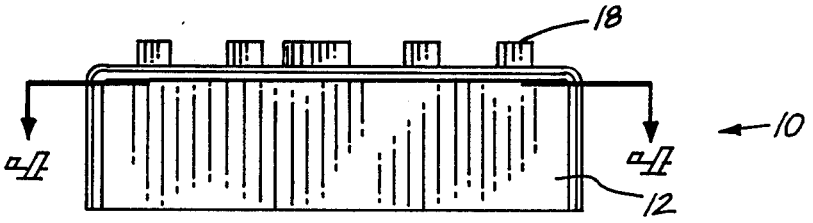
FIG. 2 is a side view of the anti-theft ski alarm of the present invention.

In FIG. 2 a side view of the housing 12 is provided.

Figure 3:
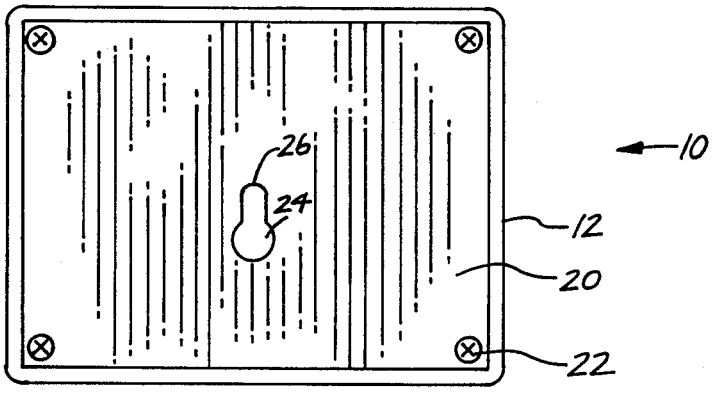
FIG. 3 is a bottom view of the anti-theft ski alarm of the present invention.

As shown in the bottom view of FIG. 3, the housing 12 is provided with a floor plate 20 which is secured to the housing 12 by a plurality of screws 22. A keyhole shaped aperture is formed centrally through the floor plate 20 and has a circular portion 24 and an elongated slotted portion 26. In use, a peg having an enlarged circular head is secured on the upper surface of a ski. The enlarged head of the peg is inserted into the circular aperture 24 and slid along the slotted portion 26. The switch 16 (FIG. 1) is then moved to a latching position which locks the peg within the slotted portion 26, by a mechanism to be subsequently described.

Figure 4:
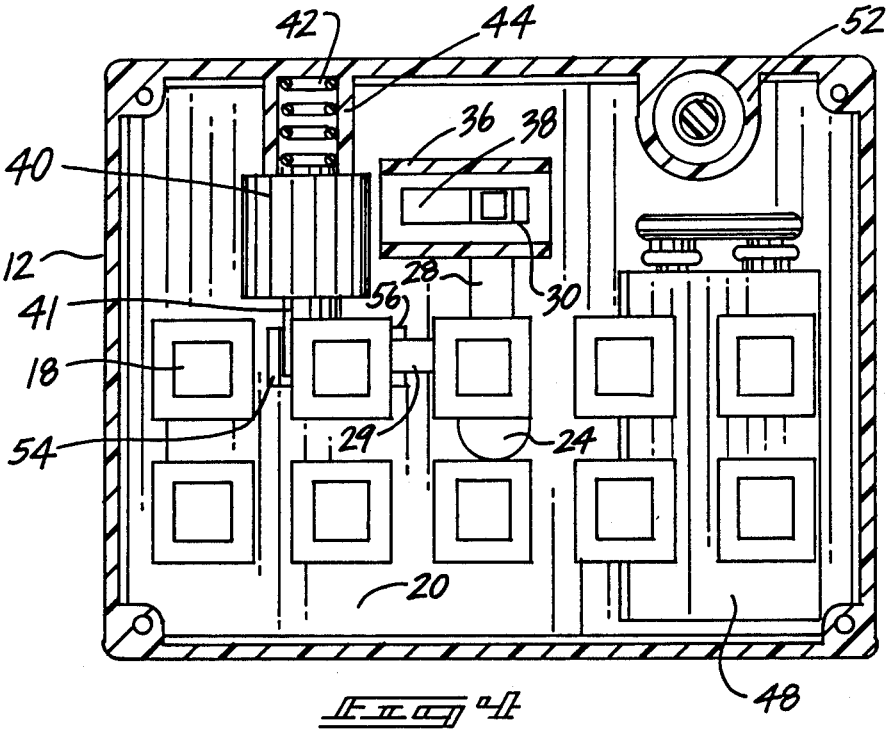
FIG. 4 is a cross sectional view, taken along line 4—4 of FIG. 2, illustrating the internal construction of the anti-theft ski alarm of the present invention.

In FIG. 4, a cross sectional view, taken along line 4—4 of FIG. 2 is provided. A latching bar has a pair of integral leg portions 28 and 29 which extend in perpendicular directions. The leg portion 28 is provided with a rectangular aperture 30 for connection with the slidable switch 16 (FIG. 1). A guide channel 36 has an elongated rectangular slot which allows the switch 16 to be slid from right to left as shown in FIG. 4. In the illustrated right hand position, the latching mechanism is in a locked condition. By sliding the switch 16 to the left as illustrated in FIG. 1, the latching mechanism may be moved to an unlock position. The leg portion 29 of the latching mechanism is received for sliding movement within a guide channel 56. The leg portion 29 may be blocked against movement to an unlock position by abutment with a solenoid rod 41 which is received by a guide channel 54. The solenoid 40, which is actuated by an electrical circuit to be described subsequently, is secured within the housing 12 by a hollow cylindrical boss 44. In an unenergized condition, the rod 41 of the solenoid 40 is biased downwardly into the guide channel 54 by a coil spring 42 situated within the boss 44. When the solenoid 40 is actuated, the rod 41 is moved upwardly, into the interior of the boss 44 against the bias of the spring 42. A battery 48 and a vibration actuation switch 52 are also located within the housing 12. The construction of the switch 52 will be subsequently described in detail.

Figure 5:
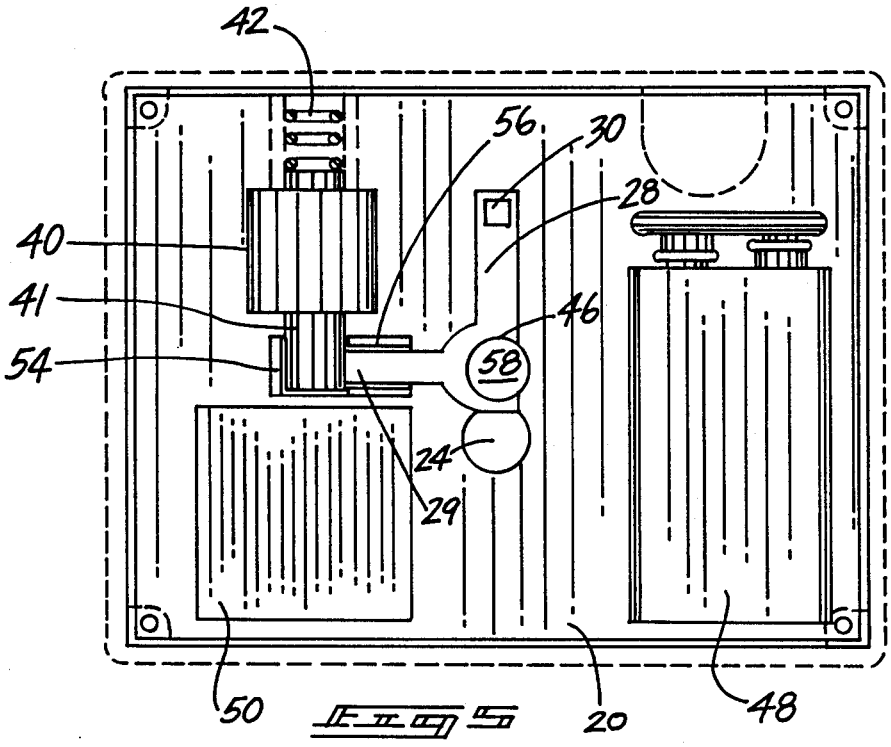
FIG. 5 is a top view of the housing interior of the anti-theft ski alarm of the present invention, with the cover removed.

With reference now to FIG. 5, a top view of the alarm 10 with the housing 12 removed, is provided. As previously described, the latching mechanism includes first 28 and second 29 leg portions which are integrally formed and extend in perpendicular directions. A notched yoke portion 46 is formed at the intersection of the leg portions 28 and 29. The enlarged circular head 58 of a peg, which is attached to the upper surface of a ski, has been inserted into the keyhole shaped aperture formed through the floor plate 20. The peg 58 has then been slid into the slotted portion 26 (FIG. 3) and has been locked in this position by sliding the switch 16 (FIG. 1) to the right hand side of the slot 14. At this point, the rod 41 of the solenoid 40 moves downwardly, by virtue of the bias of the spring 42, into the guide channel 54. In this position, the rod 41 serves as a locking bar which prevents the leg 29 of the latching mechanism from being slid to the left hand side of the channel 56. Thus, the latching mechanism may not be manually unlocked by merely sliding the switch 16 to the left hand side of the slot 14 as illustrated in FIG. 1. In order to disengage the peg 58 from the slotted yoke 46, the solenoid 40 must be actuated to retract the rod 41. This is accomplished by entering a coded sequence on the keys 18 which extend through the top surface of the housing 12, as illustrated in FIG. 1. An internal housing 50 provides a mounting for an audible alarm which may be in the form of a bell or buzzer and also for an alarm activation relay.

Figure 6:
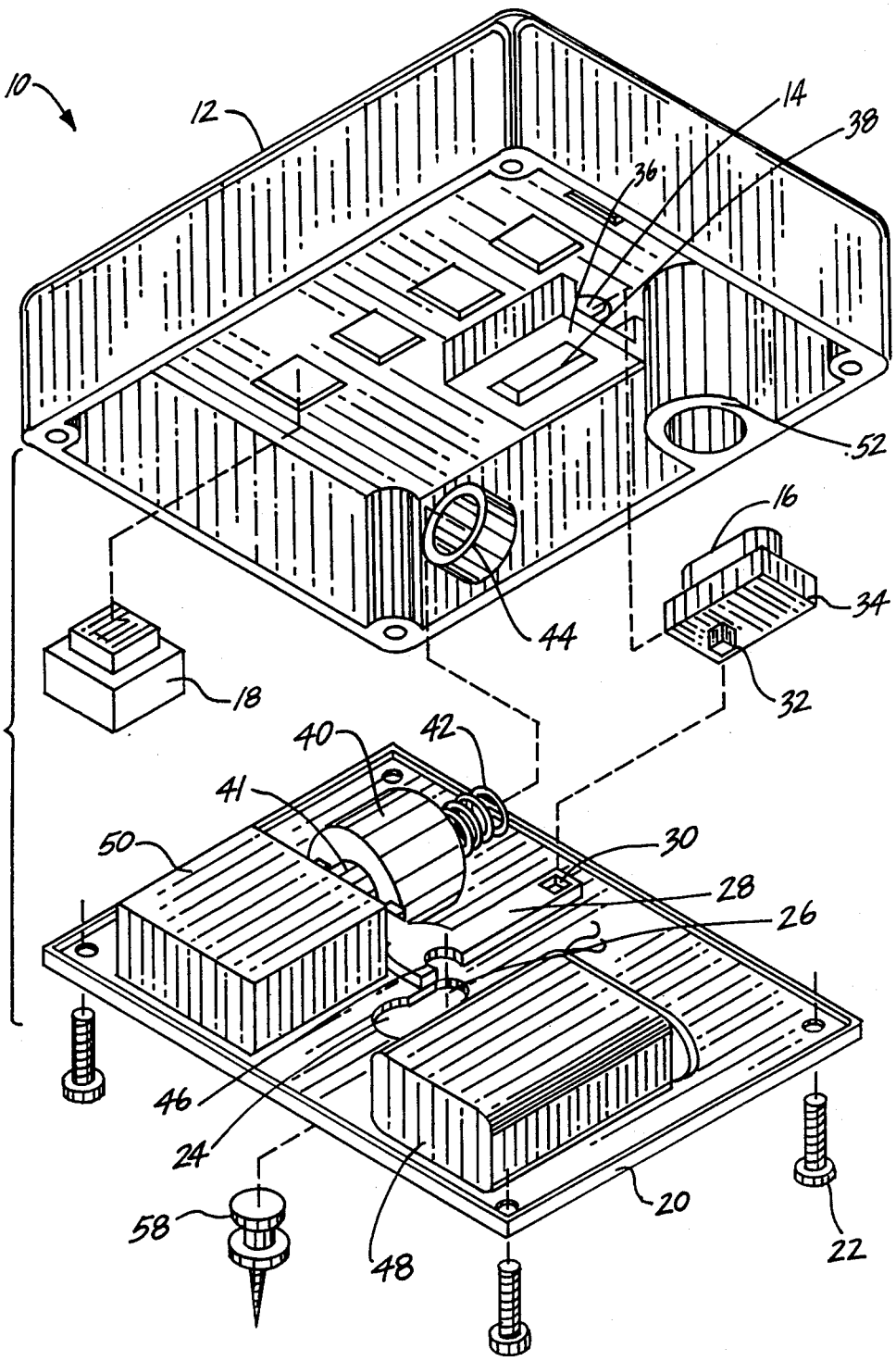
FIG. 6 is an exploded perspective view of the anti-theft ski alarm of the present invention.
Figure 11:
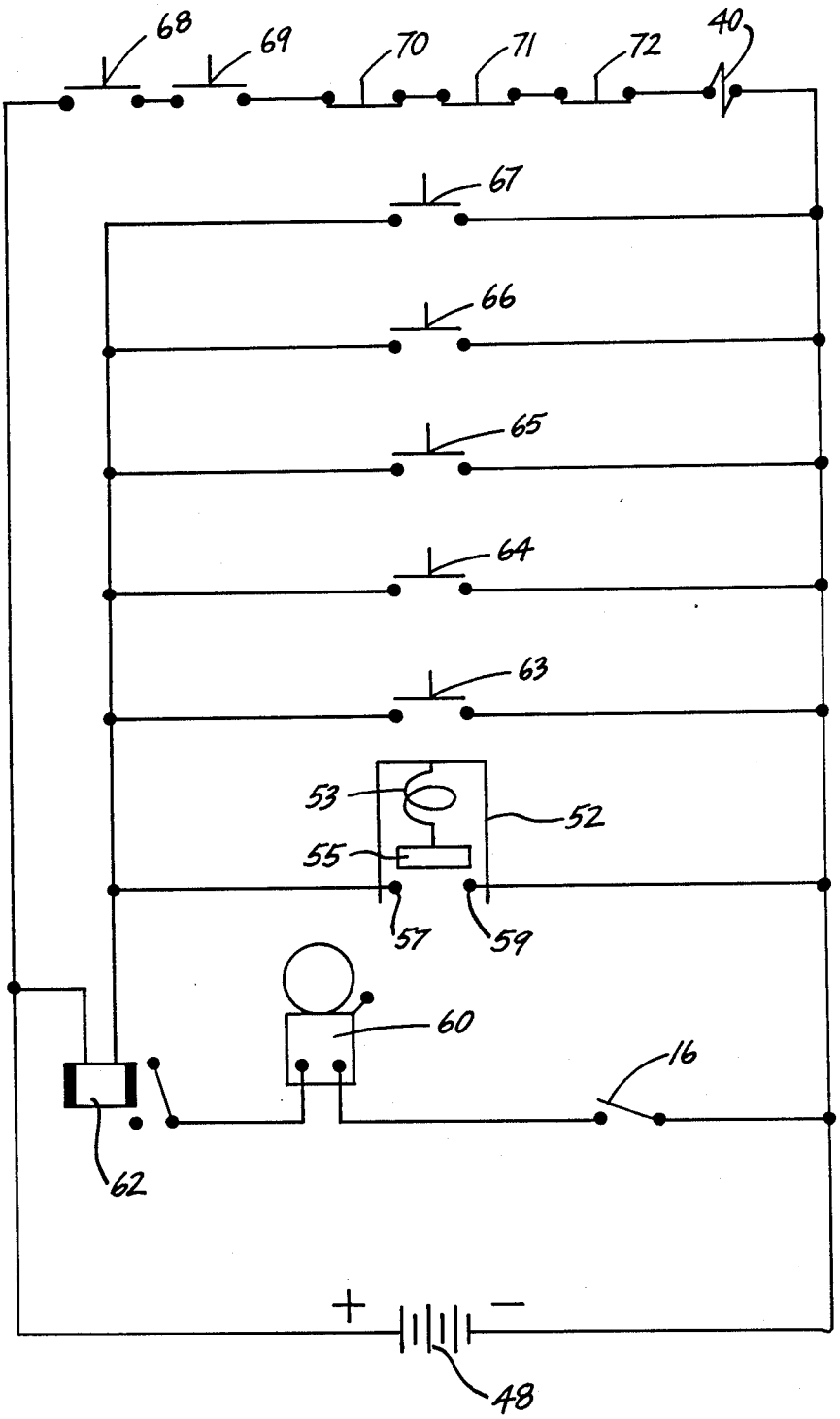

In FIG. 6, an exploded perspective view of the ski alarm 10 of the present invention is provided. As previously described, a plurality of push button type keys 18 extend through apertures formed in the top surface of the housing 12. The alarm activation switch 16 is received for reciprocal sliding movement within a channel 36 which is attached to an upper interior wall of the housing 12. The switch 16 has a rectangular body portion 34 which operates as a slide within a rectangular track formed by the channel 36. A rectangular projection 32 extends downwardly from the bottom surface of the rectangular body portion 34 and extends through a rectangular slot 38 formed in a bottom wall of the channel 36. The projection 32 engages a cooperating rectangular aperture 30 on a first leg portion 28 of the latching mechanism. Thus, by sliding the switch 16 within the slot 14, the latching mechanism may be moved between locked and unlock positions. As previously described, a solenoid 40 has a rod 41 which provides a lockout feature which prevents the switch 16 from being moved to an unlock position unless a proper code sequence has been entered on the keys 18. A keyhole shaped aperture has a circular portion 24 and an elongated slotted portion 26. A peg 58 has an enlarged circular head dimensioned to be received within the circular aperture portion 24 and slid upwardly along the slotted aperture portion 26. A notched yoke portion 46 of the latching mechanism may then be moved into engagement with the peg 58, preventing the peg 58 from being removed from the aperture 24. The peg 58 may be provided with a threaded portion as illustrated for engagement with an upper surface of a ski, or may be adhesively secured.

With reference now to FIG. 7, the circuitry of the ski alarm 10 of the present invention will now be described. A battery 48 is utilized to provide power for actuation of a relay 62, the solenoid 40 and an audible alarm 60. The battery 48, relay 62, solenoid 40 and alarm 60 are preferably of the type designed for operation with a nine volt battery power supply. The alarm activation switch 16 is initially closed after the alarm 10 is latched to the peg 58 which is secured to a ski. Movement of the switch 16 (FIG. 1) to the right hand side of the slot 14 simultaneously enables the audible alarm 60 and clamps the peg 58 within the notched yoke 46. When the alarm activation switch 16 is closed, the alarm activation relay 62 may be energized by a vibration type switch 52. The vibration switch 52 is formed from a hollow cylindrical plastic housing which is provided with a first metallic contact portion 55 suspended by a weak coil spring 53 within the cylinder 52. A pair of contacts 57 and 59 are disposed at opposite sides within the interior of the cylinder 52 such that vibration of the housing 12 of the alarm 10 causes the contact element 55 to vibrate within the cylinder 52 and momentarily bridge the contacts 57 and 59. Even momentary connection between the contact 57 and 59 is sufficient to energize the relay 62, thus completing a circuit from the nine volt battery 48 through the audible alarm 60. Once the alarm 60 has thus been actuated, it may not be deactuated by movement of the switch 16, because of the lockout feature provided by the solenoid 40. In order to disengage the alarm 10 from the peg 58, a proper coded sequence must be entered on the keys 18 (FIG. 1). The keys 18 actuate a plurality of switches. While the number of keys 18 may be varied, the illustrated embodiment will be described with reference to the provision of ten separate keys 18. The keys 18 actuate push button type switches 63, 64, 65, 66, 67, 68, 69, 70, 71 and 72. A first group of these switches 63 through 67 are connected in parallel with the relay 62 and the vibration switch 52. Thus, actuating any one of the keys 18 associated with any of the push button switches 63 through 67 will energize the solenoid 62, thus setting off the alarm 60. The switches 63 through 67 thus provide a tamper resistant feature which prevents solving of the code sequence by experimental manipulation of the keys 18. A second group of five switches 68 through 72 are connected in series with the solenoid 40. However, three of these switches 70, 71 and 72 are of the normally closed push button type. Thus, depressing any of the keys 18 associated with the switches 70, 71 or 72 will open the circuit to the solenoid 40. In order to energize the solenoid 40, the two push button type switches 68 and 69 must be simultaneously actuated. This results in a circuit connection between the battery 48 and the solenoid 40, which causes the solenoid rod 41 (FIG. 5) to be moved upwardly against the bias of the spring 42, thus allowing the switch 16 (FIG. 1) to be moved to the left, simultaneously moving the slotted yoke portion 46 of the latching mechanism out of engagement with the peg 58 and opening the alarm circuit. The alarm 10 may then be disconnected from the peg 58 and attached ski.

Figure 8:
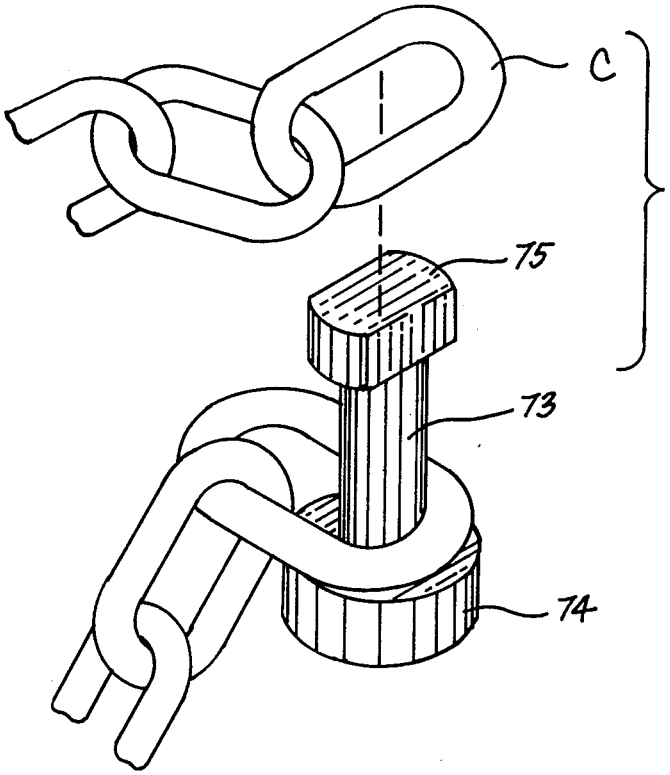
FIG. 8 is a perspective view illustrating an attachment peg and chain for attaching the alarm to various articles.

As illustrated in FIG. 8, an alternative form of peg may be utilized with the alarm device 10 of the present invention for enabling anti-theft protection of a variety of different articles. This alternative peg has an enlarged cylindrical end portion 74 which is connected by a cylindrical shank 73 to a second enlarged head portion 75. The head portion 75 is dimensioned to be received through the links of a chain C. The chain C may be engaged around any desired article and both end portions thereof inserted over the head 75. The head 75 will then be inserted within the keyhole shaped aperture 24, 26 in the floor plate 20 (FIG. 3) of the alarm 10. The cylindrical shank portion 73 may then be locked in position by engagement of the slotted yoke portion 46 (FIG. 5). This alternative peg construction may be utilized to attach a wide variety of diverse articles such as bicycles to the alarm 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An anti-theft alarm, comprising:
hollow housing means;
planar floor plate means on said housing means;
peg means, having an enlarged head portion, for securement to an article to be protected against theft;
aperture means, dimensioned to receive said enlarged head portion of said peg means, formed through said floor plate means;
latch means in said housing means for selective locking engagement with said peg means;
audible alarm means in said housing;
means for selectively activating alarm means;
means for selectively locking and unlocking said latch means;
coded electrical interlock means for preventing said alarm activating means from being deactivated, and said latch locking means from being unlocked, unless a proper code sequence is entered;
said coded electrical interlock means including an electrical solenoid in said housing for abutment with said latch means; and
a plurality of code keys and a plurality of dummy keys connected to said solenoid for energizing said solenoid upon entry of a correct code sequence.

2. The anti-theft alarm of claim 1, further comprising an electrical relay and vibration switch means operably connecting for energizing said audible alarm means.

3. The anti-theft alarm of claim 2, further comprising a plurality of dummy keys operably connected for energizing said audible alarm means.

4. The anti-theft alarm of claim 1, wherein said interlock means comprises:
battery means;
a plurality of normally open push button switches connected in series with said battery means and said solenoid;
a plurality of normally closed push button switches connected in series with said battery means and said solenoid;
a relay, and an alarm activation switch connected in series with said battery means and said audible alarm, and in parallel with said solenoid;
a plurality of normally open push button switches connected in parallel with said audible alarm for energizing said relay; and
a vibration switch connected in parallel with said audible alarm for energizing said relay.

5. An anti-theft alarm, comprising:
hollow housing means;
planar floor plate means on said housing means;
aperture means, formed through said floor plate means;
peg means for securement to an article to be protected against theft, said peg means having a first enlarged head portion connected by a reduced diameter cylindrical shank to a second head portion dimensioned to be received through links of a chain and through said aperture means;
latch means in said housing means for selective locking engagement with said peg means;
audible alarm means in said housing;
means for selectively activating said alarm means; and
means for selectively locking and unlocking said latch means.

6. An anti-theft alarm, comprising:
hollow housing means;
planar floor plate means on said housing means;
peg means, having an enlarged head portion, for securement to an article to be protected against theft;
aperture means, dimensioned to receive said enlarged head portion of said peg means, formed through said floor plate means;
latch means in said housing means for selective locking engagement with said peg means;
said latch means including a pair of perpendicular arms connected at a notched yoke portion;
audible alarm means in said housing;
means for selectively activating said alarm means; and
means for selectively locking and unlocking said latch means.

7. The anti-theft alarm of claim 6, further comprising guide channel means in said housing mounting said latch means for reciprocal sliding movement between locked and unlocked positions.

* * * * *